United States Patent [19]

Yokoya et al.

[11] Patent Number: 4,473,630

[45] Date of Patent: Sep. 25, 1984

[54] LIQUID DEVELOPER COMPRISING AMINOALKYL STYRENE POLYMER FOR ELECTROSTATIC IMAGES

[75] Inventors: Hiroaki Yokoya; Hiromichi Tachikawa; Nobuo Suzuki; Shu Watarai, Saitama, all of Japan

[73] Assignee: Fuji Photo Film Co., Ltd., Kanagawa, Japan

[21] Appl. No.: 451,221

[22] Filed: Dec. 20, 1982

[30] Foreign Application Priority Data

Dec. 18, 1981 [JP] Japan ..... 56-203404

[51] Int. Cl.[3] ..... G03G 9/18

[52] U.S. Cl. ..... 430/114; 430/137

[58] Field of Search ..... 430/114, 137, 116

[56] References Cited

U.S. PATENT DOCUMENTS 4,181,620 1/1980 Tsubuko ..... 430/114

4,357,363 11/1982 Pierce ..... 427/2

*Primary Examiner*—John E. Kittle

*Assistant Examiner*—John L. Goodrow

*Attorney, Agent, or Firm*—Sughrue, Mion, Zinn, Macpeak & Seas

[57] ABSTRACT

A liquid developer for electrostatic images which comprises toner particles dispersed in a nonaqueous medium having an electrical resistance of $10^9$ Ω·cm or more and a dielectric constant of 3 or less, wherein said toner particles are composed of a resin polymer comprised of monomer units selected from the group of monomers represented by the following formula (I) and a coloring agent:

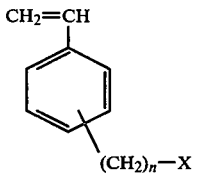

(I)

wherein X represents

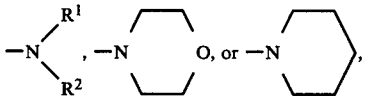

and n represents an integer of 1–6, wherein $R^1$ and $R^2$ each represents an alkyl group having 1–18 carbon atoms, and alkyl substituted or nonsubstituted aryl group (the substituent being an alkyl group having 1–12 carbon atoms), or an aralkyl group (substituent alkyl groups in case that the benzene nucleus is substituted by alkyl groups have 1–12 carbon atoms, and the alkylene group has 1–12 carbon atoms).

16 Claims, No Drawings

LIQUID DEVELOPER COMPRISING AMINOALKYL STYRENE POLYMER FOR ELECTROSTATIC IMAGES

BACKGROUND OF THE INVENTION

The present invention relates to a liquid developer for developing electrostatic images formed by electrophotography or electrostatography such as electrostatic recording, etc.

Liquid developers for electrostatic images are generally composed of a nonaqueous medium having a high electrical resistance and a low dielectric constant such as aliphatic hydrocarbons or toluene, etc. and particles of various kinds of coloring agents such as carbon black or phthalocyanine, etc. dispersed therein. Generally, a resin is allowed to adhere to the surface of particles of the coloring agent in order to control electrostatic charges and bestow dispersibility or fixability, etc. so that the coloring agent can be used as a toner. Further, if necessary, additives such as a dispering agent or a polarity controller, etc. are added to the nonaqueous medium.

Examples of known resins which adhere to the coloring agent include natural resins and synthetic resins such as rosin, natural rubber, alkyd resin, phenol resin, epoxy resin, pentaerythritol resin, acryl resin and synthetic rubber. However, there are practical problems with using these resins. For example, it is difficult to obtain the natural resins in constant quality and the synthetic resins such as acryl resin are not desirable because sufficient dispersibility and fixability can not always be obtained and aggregation or precipitation of particles is easily caused by the passage of time.

The present inventors have carried out earnest studies in order to improve the above described faults and have developed the present invention.

SUMMARY OF THE INVENTION

An object of the present invention is to improve dispersibility of a toner for the liquid developer for electrostatic images composed of coloring agent particles and a resin in the liquid developer so as to improve preservation stability when preserving the developer for a long period of time.

The second object of the present invention is to provide a liquid developer for electrostatic images having excellent fixability.

The developer of the present invention is a liquid developer for electrostatic images which comprises toner particles dispersed in a nonaqueous medium having an electrical resistance of $10^9\Omega\cdot$cm or more and a dielectric constant of 3 or less, wherein said toner particles are composed of a resin comprising a polymer composed of at least one of monomers represented by the following formula (I) and a coloring agent:

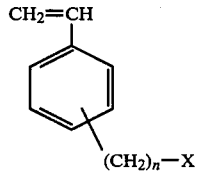

(I)

wherein X represents

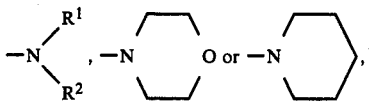

and n represents an interger of 1–6, wherein $R^1$ and $R^2$ each represents an alkyl group having 1–18 carbon atoms, an alkyl substituted or nonsubstituted aryl group (the substituent being an alkyl group having 1–12 carbon atoms), or an aralkyl group (substituent alkyl groups in case that the benzene nucleus is substituted by alkyl groups have 1–12 carbon atoms, and the alkylene group has 1–12 carbon atoms).

DETAILED DESCRIPTION OF THE INVENTION

Aminoalkylstyrenes or derivatives thereof described by the above described general formula may be any of o-, m- and p-compounds. These compounds are effective components for improving characteristics of a resin used in forming toner particles, because polymers composed of such monomer compounds contribute to improvement of dispersibility of the toner particles. Particularly, when a polymer comprised of the above described monomer is incorporated in the resin for forming toner particles, the toner particles can be easily divided into finer particles and their dispersibility is improved. Further, the fixability of the above described resin is generally improved, because the resin has a comparatively low softening point.

The softening point of the resin varies depending on the method and temperature of fixation and preferably it is 40° o 180° C. more preferably 50° to 150° C.

Examples of compounds represented by the above described general formula include N,N-dimethylaminomethylstyrene, N,N-diethylaminomethylstyrene, N,N-dipropylaminomethylstyrene, N,N-dibutylaminomethylstyrene, N,N-dihexylaminomethylstyrene, N,N-dioctylaminomethylstyrene, N,N-dilaurylaminomethylstyrene, N,N-distearylaminomethylstyrene, N,N-dimethylaminoethylstyrene, N,N-diethylaminoethylstyrene, N,N-dipropylaminoethylstyrene, N,N-dibutylaminoethylstyrene, N,N-dihexylaminoethylstyrene, N,N-dioctylaminoethylstyrene, N,N-dilaurylaminoethylstyrene, N-ethylaminomethylstyrene, N-propylaminomethylstyrene, N-butylaminomethylstyrene, N-butylaminomethylstyrene, N-octylaminoethylstyrene, N-laurylaminomethylstyrene, N-methyl-N-phenylaminomethylstyrene, N-ethyl-N-phenylaminomethylstyrene, N-methyl-N-benzylaminomethylstyrene, N-ethyl-N-benzylaminomethylstyrene, morpholinomethylstyrene, morpholinoethylstyrene, piperidinomethylstyrene, piperidinoethylstyrene, N-naphthyl-N-ethylaminomethylstyrene, N-naphthyl-N-ethylaminoethylstyrene, N-anthryl-N-ethylaminomethylstyrene, N-anthryl-N-ethylaminoethylstyrene, N-phenanthryl-N-ethylaminomethylstyrene and N-phenanthryl-N-ethylaminoethylstyrene, etc. Any of o-, m- and p-compounds of these compounds can be used.

In the present invention, at least one of homopolymers comprised of monomer compounds represented by the above described general formula or copolymers of two or more of them is used as a resin for forming the toner. Further, in the present invention, it is possible to use copolymers of polymerizable monomers other than the above desribed compounds, such as styrenes, for example, styrene and vinyltoluene, etc. or acrylic esters such as alkyl acrylates (carbon number in the alkyl group: 1–18 preferably 1–12), alkyl methacrylates (carbon number in the alkyl group: 1–18 preferably 1–12) or glycidyl methacrylate, etc., and graft polymers grafted with vinyl acetate, acrylic acid, methacrylic acid and polymers having unsaturated groups such as unsaturated alkyd, styrene butadiene rubber, butadiene rubber or cyclized rubber, etc.

In this case, though the amount of compounds represented by the above described general formula introduced into the polymer is not particularly restricted, the compounds are introduced in such a range that a polymer which does not completely dissolve in the nonaqueous solvent as the carrier liquid can be obtained. It is generally preferred to introduce the monomer compounds of the above formula in an amount of at least 0.1% by mol and, preferably, 1.0% by mol or more, more preferably, 5.0% by mol or more. The molecular weight of the above described homopolymers and copolymers is not particularly restricted. It is only necessary that the homopolymers and copolymers do not completely dissolve in the carrier liquid. According to a conventional polymerization means, polymers having a molecular weight of $10^3$–$10^7$, preferably $10^4$–$10^6$ are easily obtained, and the objects of the present invention can be sufficiently attained by using such polymers.

Further, in the present invention, it is possible to use, resins for forming the toner which are insoluble or swell in the nonaqueous solvent used in the developer of the present invention together with the polymer composed of compounds represented by the above described general formula. Examples of such resins include natural resins and synthetic resins such as alkyd resin, phenol resin modified with natural resin, polyterpene, maleic acid resin modified with natural resin, pentaerythritol resin modified with natural resin, rosin type resin, styrene resin, acrylic resin, butadiene rubber, styrene butadiene rubber, and natural rubber, etc. These resins are used as a mixture with the polymer composed of compounds represented by the above described general formula. A ratio of the resins used is not particularly restricted. It is only necessary that the effect of improving dispersibility of the toner be obtained by including a sufficient amount of the above described polymer. A suitable amount of the resins used depends upon the polymer and properties of the resin used in combination with it, but it is generally used in an amount of 0.01–100 parts by weight based on part by weight of the polymer.

In general, any suitable process can be used for producing the polymer of the present invention. Namely, any process for polymerization may be used, if a homopolymer or a copolymer comprising the monomer compounds represented by the above described general formula as polymer components is obtained as a product. Examples of useful processes for polymerization include a process for solution polymerization and a process for suspension polymerization.

Examples of useful nonaqueous solvents having an electrical resistance of $10^9\Omega\cdot$cm or more and a dielectric constant of 3 or less include aliphatic hydrocarbons, alicyclic hydrocarbons, aromatic hydrocarbons and halogenated hydrocarbons, etc., but isoparaffin petroleum solvents are preferred with respect to characteristics such as volatilization, safety, toxic character and smell, etc. Examples of useful isoparaffin petroleum solvents include Isopar G, Isopar H and Isopar L produced by Esso Co., etc.

| | Initial Boiling Point | Dry Point | Aniline Point |
|---|---|---|---|
| Isopar G | 158° C. | 177° C. | 80° C. |
| Isopar H | 174° C. | 189° C. | 83° C. |
| Isopar L | 188° C. | 210° C. | 86° C. |

Examples of useful coloring agents include known pigments and/or dyes conventionally used for liquid developers. Examples of them include Hansa Yellow (C.I. 11680), Benzidine Yellow G (C.I. 21090), Benzidine Orange (C.I. 21110), Fast Red (C.I. 37085), Brilliant Carmine 3B (C.I. 16015-Lake), Phthalocyanine Blue (C.I. 74160), Phthalocyanine Green (C.I. 74260), Victoria Blue (C.I. 42595-Lake), Spirit Black (C.I. 50415), Oil Blue (C.I. 74350), Alkali Blue (C.I. 42770A), Fast Scarlet (C.I. 12315), Rhodamine 6B (C.I. 45160), Fast Sky Blue (C.I. 74200-Lake), Nigrosine (C.I. 50415) and carbon black, etc.

In the present invention, the ratio of the coloring agent in the toner particles to the resin comprising the polymer composed of compounds represented by the above described formula is suitably selected. The resin is present in an amount of 0.01–100 parts by weight, preferably, 0.1–10 parts by weight per part by weight of the coloring agent.

The toner used in the developer of the present invention can be produced by known processes. In the following, examples of the processes are described.

First, a coloring agent consisting of a pigment and/or a dye and a resin for forming the toner particles are blended in a solvent for said resin by means of a blender such as a ball mill, a roll mill or a paint shaker, etc., and the solvent is removed by heating, etc. to obtain a mixture.

The above described blending product may be poured into a liquid which does not dissolve the above described resin to obtain a mixture by reprecipitation.

Furthermore, a coloring agent and a resin can be kneaded by means of a blender such as a kneader, etc. with heating to a temperature higher than the softening point of the resin, and the kneaded product is cooled to obtain a mixture.

The mixture obtained as described above is subjected to dry grinding and/or wet grinding to obtain toner particles. When using a resin containing the above described polymer, particles having a small particle size are easily obtained. It is generally suitable if the particle size of the toner particles is 1–0.05$\mu$.

Production of the toner is not restricted to the above described process, and any known process may be used if toner particles composed of a coloring agent and the above described resin are finally obtained.

The toner obtained as described above is dispersed in the above described nonaqueous solvent to obtain a liquid developer for electrostatic images. The concentration of the toner in the developer is not particularly limited, but it is generaly 0.001 g–100 g and, preferably, 0.01 g–10 g per liter of the solvent.

In the present invention, known additives such as a dispersing agent or a charge controller, etc. can be added to the developer by the same method as the prior method, in order to further improve the dispersibility of the toner and to control the charges.

The term "dispersing agent" means resins which dissolve or swell in the nonaqueous solvent having a high electrical resistance which is used for the developer of the present invention to improve dispersibility of the toner. Examples of these agents include synthetic rubbers such as styrene-butadiene rubber vinyltoluene-butadiene rubber or butadiene-isoprene rubber, etc., long chain acrylic resins and copolymers of long chain acrylic compounds and other polymerization monomers such as 2-ethylhexyl methacrylate, lauryl methacrylate, stearyl methacrylate, lauryl acrylate, octyl acrylate, styrene-lauryl methacrylate copolymer ro acrylic acid-lauryl methacrylate, etc., polyolefins such as polyethylene, etc. and polyterpenes, etc.

The term "charge controller" means substances which contribute to the charging of toner particles, examples of which include soaps of long chain aliphatic acid such as naphthenic acid, octenic acid, stearic acid or lauric acid, etc. with polyvalent metals. Examples of effective polyvalent metals include calcium, barium, manganese, copper, zinc, lead, zirconium and transition metals such as cobalt or nickel. In addition to them, it is effective to use organic phosphorus compounds such as triphenyl phosphite or trioctadecyl phosphite, organic acid esters of polyhydric alcohols, phenol derivatives of aliphatic compounds, nonionic surface active agents, lecithin, linseed oil and higher aliphatic acids, etc.

The above described additives can be used as occasion demands in order to improve properties of the liquid developer of the present invention.

The liquid developer of the present invention has excellent stability with the passage of time, and the fixability of the toner is excellent.

Aminoalkylstyrenes used in the present invention, derivatives thereof and polymers composed of them as polymerization components are obtained by processes described in the following synthesis examples.

Process for synthesizing monomers:

SYNTHESIS EXAMPLE 1

175.4 g of diethylamine and 152.5 g of chloromethylstyrene (mixture of m- and p- compounds) were dissolved in 300 ml of toluene, and the resulting solution was heated to 60°-70° C. for 13 hours. Diethylamine hydrochloride was separated during the progress of the reaction. After the hydrochloride was filtered out, the filtrate was washed with water. The toluene phase was dried with anhydrous sodium sulfate and thereafter concentrated. After adding 1 g of di-tert-butylcatechol, reduced pressure distillation was carried out to obtain 120.2 g of diethylaminomethylstyrene. (b.p.: 60° C./2 mm Hg, colorless liquid)

SYNTHESIS EXAMPLES 2-5

Monomers represented by the following general formula were synthesized by reacting chloromethylstyrene with secondary amines shown in Table 1 by the same procedure as in Synthesis Example 1.

TABLE 1

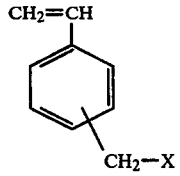

| Synthesis Example | Secondary amine | X in the monomer |
|---|---|---|
| 2 | Di-n-butylamine | $-N(n\text{-}C_4H_9)_2$ |
| 3 | Di-n-octylamine | $-N(n\text{-}C_8H_{17})_2$ |
| 4 | Piperidine | 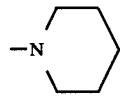 |
| 5 | Morpholine | 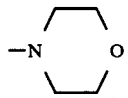 |

SYNTHESIS EXAMPLE 6

Synthesis was carried out according to the process described by Tsuruta et al in "Makromolekular Chemie" 177, 3255 (1976).

65.0 g of divinylbenzene (55% solution of a mixture of m- and p-compounds in benzene) was dissolved in 100 ml of cyclohexane, and an amine-amide compound obtained by reacting 64.5 g of di-n-butylamine with 25 millimoles of n-butyl lithium was added dropwise thereto. After completing the addition, the resulting mixture was heated to 50° C. for 3 hours. 1 ml of methanol was added to the reaction mixture. After the mixture was concentrated, 1 g of di-tert-butyl-catechol was added and reduced-pressure distillation was carried to obtain 53.5 g of di-n-butylaminoethylstyrene. b.p.: 100.0°-101.0° C./1 mm Hg, colorless liquid.

Process for synthesizing polymers:

SYNTHESIS EXAMPLE 7

To a 300 ml glass vessel equipped with a stirrer, a reflux condenser and a nitrogen inlet, 31.5 g of styrene monomer, 18.5 g of the monomer obtained in Synthesis Example 2, 310 mg of azobisisobutyronitrile and 75 g of toluene were added. Polymerization was carried out at 80° C. for 8 hours with stirring under a nitrogen stream to obtain a solution containing a copolymer. The solution was poured into 1.5 liters of methanol, and the precipitated white polymer was dried under reduced pressure at room temperature by means of a vacuum pump. The resulting polymer was dissolved in 100 g of chloroform, and the resulting solution was poured into 1.5 liters of methanol to precipitate the polymer again. The polymer was dried in the same manner as described above to obtain a purified white powder of the polymer. In the resulting copolymer, the ratio of the monomer of Synthesis Example 2 was 20% by mol.

SYNTHESIS EXAMPLES 8-13

Copolymers shown in Table 2 were produced by the same process as in Synthesis Example 7.

TABLE 2

| Synthesis Example | Monomer 1 | Monomer 2 | Ratio of Monomer 2 |
|---|---|---|---|
| 8 | Styrene | Monomer of Syn. Ex. 2 | 10% by mol |
| 9 | Styrene | Monomer of Syn. Ex. 6 | 9% by mol |
| 10 | Styrene | Monomer of Syn. Ex. 3 | 8% by mol |
| 11 | Methyl methacrylate | Monomer of Syn. Ex. 1 | 11% by mol |
| 12 | Methyl methacrylate | Monomer of Syn. Ex. 2 | 10% by mol |
| 13 | Methyl methacrylate | Monomer of Syn. Ex. 3 | 10% by mol |

SYNTHESIS EXAMPLE 14

To a 300 ml glass equipped with a stirrer, a reflux condenser and a nitrogen inlet, 26 of styrene monomer, 11 g of n-butyl methacrylate, 13 g of the monomer of Synthesis Example 3, 298 mg of azobisisobutyronitrile and 75 g of tolune were added. Polymerization was carried out at 80° C. for 8 hours with stirring under a nitrogen stream to obtain a solution containing a terpolymer. From this solution, a white powder was obtained in the same manner as in Synthesis Example 7. In the resulted terpolymer, the ratio of the monomer of Synthesis Example 3 was 10% by mol.

EXAMPLE 1

3.5 parts by weight of carbon black (Mitsubishi 40) as a pigment and 3.5 parts by weight of the copolymer of Synthesis Example 7 as a polymer comprising aminoalkylstyrene were blended with 17.3 parts by weight of toluene and 70 parts by weight of glass beads for 90 minutes by means of a paint shaker (produced by Toyo Seiki Co.). The mixture excluding glass beads was poured into Isopar H (produced by Esso Res. & Lab. Co.), and the resulting precipitate (14 parts by weight) was filtered out. 1 part by weight of the resulting precipitate was blended with a solution of Solprene 1204 (styrene-butadiene rubber, produced by Nippon Elastomer Co.) in Isopar H (5% by weight), and the mixture was blended with 25 parts by weight of glass beads for 90 minutes by means of a paint shaker. 1 part by weight of the resuling dispersion was diluted with 100 parts by weight of Isopar H to obtain a liquid developer for electrostatic images. The resulting developer had excellent dispersibility.

COMPARATIVE EXAMPLE

A developer was produced by the same procedure as in Example 1 except that a homopolymer of styrene which did not contain aminoalkylstyrene derivatives was used instead of the copolymer of Synthesis Example 7. As compared with the developer obtained in the Comparative Example, the developer of Example 1 had a small particle size of toner particles and the particle size thereof was uniform (average particle size of toner in Example 1: 0.5 $\mu$, and average particle size of toner in this Comparative Example: more than 0.5$\mu$).

Aggregation and precipitation occurred within two weeks in the developer of the Comparative Example, while aggregation and precipitation were hardly observed in the developer of Example 1 after being allowed to stand for 1 month. Further, since the copolymer used in Example 1 had a lower softening point than the styrene homopolymer of the Comparative Example, fixation could be attained at a lower temperature when carrying out thermal fixation. (Softening point of copolymer of Synthesis 7: 60°-71° C., and softening point of styrene homopolymer: 98°-100° C).

EXAMPLE 2

A liquid developer was prepared by the same procedure as in Example 1, except that the copolymer of Synthesis 8 was used instead of the copolymer of Synthesis Example 7. The resulting liquid developer had excellent dispersibility, fixability and stability with the passage of time.

EXAMPLES 3-8

Liquid developers were prepared by the same procedure as in Example 1, except that the copolymers of Synthesis Examples 9-14 were used, respectively, instead of the copolymer of Synthesis Example 7. All of the resulting liquid developers had excellent dispersibility, fixability and stability with the passage of time.

EXAMPLE 9

A liquid developer was prepared by the same procedure as in Example 1, except that 1.75 parts by weight of the copolymer of Synthesis Example 9 and 1.75 parts by weight of Solprene 303 (styrene-butadiene rubber; molar ratio: 48:52; produced by Asahi Chem. Ind. Co.) were used instead of 3.5 parts by weight of the copolymer of Synthesis Example 7. The resulting liquid developer was excellent in dispersibility, fixability and stability with the passage of time.

While the invention has been described in detail and with reference to specific embodiment thereof, it will be apparent to one skilled in the art that various changes and modifications can be made therein without departing from the spirit and scope thereof.

What is claimed is:

1. A liquid developer for electrostatic images which comprises toner particles dispersed in a nonaqueous medium having an electrical resistance of $10^9 \cdot \Omega \cdot$cm or more and a dielectric constant of 3 or less, wherein said toner particles are obtained by grinding a mixture of a coloring agent and a resin polymer comprised of monomer units selected from the group of monomers represented by the following formula (I)

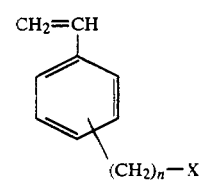

(I)

wherein X represents

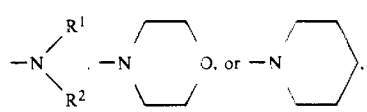

and n represents an integer of 1-6, wherein $R^1$ and $R^2$ each represents an alkyl group having 1-18 carbon atoms, an alkyl substituted or nonsubstituted aryl group (the substituent being an alkyl group having 1–12 carbon atoms), or an aralkyl group (substituent alkyl groups in case that the benzene nucleus is substituted by alkyl group having 1–12 carbon atoms, and the alkylene group has 1–12 carbon atoms), said resin polymer not completely dissolving in said nonaqueous medium.

2. A liquid developer for electrostatic images as claimed in claim 1, wherein the resin polymer is comprised of a plurality of monomer units represented by the general formula (I), and wherein some of the monomer units are ortho compounds, meta compounds, and para compounds.

3. A liquid developer for electrostatic images as claimed in claim 1, wherein the resin polymer contains the monomer units in an amount of 0.1% mol or more.

4. A liquid developer for electrostatic images as claimed in claim 3, wherein the resin polymer contains the monomer units in an amount of 1.0% by mol or more.

5. A liquid developer for electrostatic images as claimed in claim 4, wherein the resin polymer contains the monomer units in an amount of 5.0% by mol or more.

6. A liquid developer for electrostatic images as claimed in claim 1, wherein the resin polymer has a molecular weight of about $10^3$ to $10^7$.

7. A liquid developer for electrostatic images as claimed in claim 6, wherein the resin polymer has a molecular weight of $10^4$ to $10^6$.

8. A liquid developer for electrostatic images as claimed in claim 1, further comprising an additional resin compound.

9. A liquid developer for electrostatic images as claimed in claim 8, wherein the additional resin compound is present in an amount of 0.01 to 100 parts by weight per 1 part by weight of the resin polymer.

10. A liquid developer for electrostatic images as claimed in claim 1, wherein the coloring agent is present in an amount of 1 part by weight per 0.01 to 100 parts by weight of the polymer resin.

11. A liquid developer for electrostatic images as claimed in claim 10, wherein the coloring agent is present in an amount of 1 part by weight per 0.1 to 10 parts by weight of the resin polymer.

12. A liquid developer for electrostatic images as claimed in claim 1, wherein the toner particles have a size of about 1 to 0.05μ.

13. A liquid developer for electrostatic images as claimed in claim 1, wherein the toner particles are present within the nonaqueous medium in an amount of 0.001 grams to about 100 grams per liter of the nonaqueous medium.

14. A liquid developer for electrostatic images as claimed in claim 9, wherein the toner particles are present within the nonaqueous medium in an amount of about 0.01 grams to about 10 grams per liter of the nonaqueous medium.

15. A liquid developer for electrostatic images as claimed in claim 1, wherein the resin polymer has a softening point of 40° to 180° C.

16. A liquid developer for electrostatic images as claimed in claim 15, wherein the resin polymer has a softening point of 50° to 150° C.

* * * * *